US009826778B2

(12) United States Patent
Simpson et al.

(10) Patent No.: US 9,826,778 B2
(45) Date of Patent: Nov. 28, 2017

(54) SLEEVE

(71) Applicant: British American Tobacco (Investments) Limited, London (GB)

(72) Inventors: Michael Simpson, Tokyo (JP); Richard Young, London (GB); John Richardson, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/403,965

(22) PCT Filed: May 24, 2013

(86) PCT No.: PCT/GB2013/051393

§ 371 (c)(1),
(2) Date: Nov. 25, 2014

(87) PCT Pub. No.: WO2013/175242

PCT Pub. Date: Nov. 28, 2013

(65) Prior Publication Data

US 2015/0189914 A1 Jul. 9, 2015

(30) Foreign Application Priority Data

May 25, 2012 (GB) ..... 1209261.5

(51) Int. Cl.
*A24F 15/14* (2006.01)
*B65D 59/04* (2006.01)
(Continued)

(52) U.S. Cl.
CPC ..... *A24F 15/14* (2013.01); *B65D 59/04* (2013.01); *B65D 83/02* (2013.01); *B65D 85/08* (2013.01)

(58) Field of Classification Search
CPC ..... B65D 83/02; B65D 59/04; B65D 85/20; A24F 15/14
(Continued)

(56) References Cited

U.S. PATENT DOCUMENTS 3,039,908 A * 6/1962 Parmele ..... A24D 3/0233 131/341
3,207,212 A * 9/1965 Carlson ..... B01L 9/00 165/185
3,984,000 A 10/1976 Miller

FOREIGN PATENT DOCUMENTS

DE 8409781 U1 7/1984
DE 202011107974 U1 2/2012
(Continued)

OTHER PUBLICATIONS

International Search Report and Written Opinion, dated Sep. 18, 2013, for PCT/GB2013/051393, filed May 24, 2013.
(Continued)

*Primary Examiner* — Andrew Perreault
(74) *Attorney, Agent, or Firm* — Cantor Colburn LLP

(57) ABSTRACT

A sleeve (1) for holding a plurality of elongate elements (9) positioned in end-to-end relationship is disclosed. The sleeve has an elongate body (2) with opposite ends (10,11) and a space (3) defined therebetween to receive the elongate elements (9). The elongate body has an opening (4) between the ends (10,11) that is configured to enable a user to contact elongate elements (9) received in the sleeve (1) through the opening (4) and push them along, and out of one end of the sleeve (1).

16 Claims, 4 Drawing Sheets

(51) Int. Cl.
*B65D 83/02* (2006.01)
*B65D 85/08* (2006.01)

(58) Field of Classification Search
USPC ..... 206/443
See application file for complete search history.

(56) References Cited

FOREIGN PATENT DOCUMENTS

| | | | |
|---|---|---|---|
| EP | 1859694 | A1 | 11/2007 |
| JP | 06286781 | A | 10/1994 |
| WO | 9802358 | A1 | 1/1998 |
| WO | 2011121328 | A2 | 10/2011 |
| WO | 2013004994 | A1 | 1/2013 |
| WO | 2013175242 | A1 | 11/2013 |

OTHER PUBLICATIONS

Examination Report-Communication pursuant to Article 94 (3) EPC for corresponding application EP 13 729 049.0; Report dated Apr. 6, 2016.
International Search Report for corresponding application PCT/EP2014/077232 filed Dec. 10, 2014; Mail date Mar. 20, 2015.
Translation of Japanese office action received for Japanese patent application No. 2015-513281 Feb. 23, 2016.

* cited by examiner

SLEEVE

CLAIM FOR PRIORITY

This application is the National Stage of International Application No. PCT/GB2013/051393, filed May 24, 2013, which in turn claims priority to and benefit of British Patent Application No. GB1209261.5, filed May 25, 2012. The entire contents of the aforementioned applications are herein expressly incorporated by reference.

TECHNICAL FIELD

The invention relates to a sleeve for holding elongate elements, particularly but not exclusively for a plurality of rod shaped elements such as filter units for smoking articles that are held within the sleeve in end-to-end relationship until required for use. A sleeve with a plurality of elongate elements positioned within it is also disclosed, together with a method of dispensing an elongate element from a sleeve according to the invention.

BACKGROUND

Filter units for smoking articles, such as cigarettes, are formed from fibrous cellulose acetate and have a cylindrical shape, allowing them to be incorporated into a smoking article or filter of a smoking article. Filter units, which are commonly used for 'roll your own' cigarettes, are commonly packaged in cellophane or a similar flexible material that is wrapped around the filter units.

SUMMARY

In accordance with embodiments of the invention, there is provided a sleeve for holding a plurality of elongate elements positioned in end-to-end relationship, comprising an elongate body having opposite ends and defining a space therebetween to receive said elongate elements, the elongate body having an opening between said ends that is configured to enable a user to contact elongate elements received in said sleeve through said opening and push them along, and out of one end of, said sleeve.

The elongate body may be substantially cylindrical in shape and the opening may extend in a longitudinal direction between said ends.

The opening may be defined between two opposing edges of the body portion, said edges may be spaced from each other.

The opposing edges can be spaced from each other by a constant distance for the length of the opening.

The opposing edges may be spaced from each other by a distance that varies along the length of the opening.

The distance may vary between a maximum and a minimum distance along the length of the opening.

Each edge may have a waveform shape.

The waveform shape may have peaks and troughs, the peaks and troughs of each edge may be in alignment with each other along the length of the opening.

The waveform shape of each edge may be continuously curved.

The opposing edges can be spaced from each other at their widest point by a maximum distance that equates to up to half the total circumference of the sleeve.

The opening may be continuous along the length of the body portion.

The opening can extend for the entire length of the body portion.

The opening may comprise a series of discrete openings spaced from each other along the length of the body portion.

The opposing edges may be flattened or angled so that when a user makes contact with an elongate element through the opening, contact will be made with said flattened surface.

A plurality of elongate elements may be positioned in end-to-end relationship and received within said elongate body, wherein the pitch of the waveform shape can be selected such that it is substantially the same as the length of an elongate element received therein.

The sleeve may also comprise a strip that covers the opening, said strip comprising a pull tab such that a user can at least partially remove the strip from the sleeve by pulling on the pull tab.

In accordance with embodiments of the invention, there is also provided a method of dispensing an elongate element from a sleeve which is configured to hold a plurality of elongate elements positioned in end-to-end relationship therein, the method comprising contacting an elongate element to be dispensed through an opening between said ends of said sleeve and pushing against said elongate element to slide it along and out of one end of said sleeve.

The method may include holding the sleeve in one hand and contacting an elongate element to be dispensed with the thumb of the same hand to push said elongate element along and out of one end of said sleeve.

The elongate elements may be filter units for a smoking article.

The elongate elements may be inserts that are insertable into a filter unit of a smoking article.

BRIEF DESCRIPTION OF THE DRAWINGS

Embodiments of the invention will now be described, by way of example only, with reference to the accompanying drawings in which.

DETAILED DESCRIPTION

Figure 1:
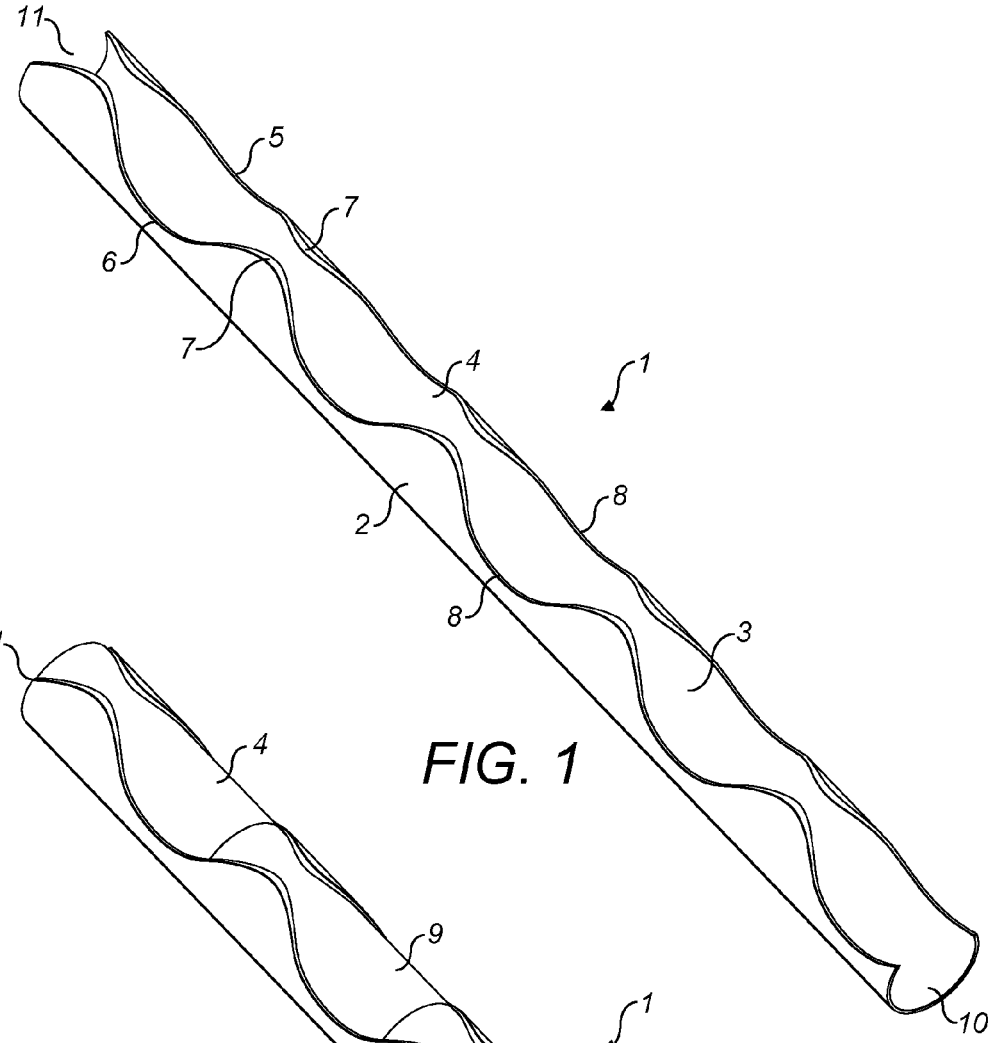
FIG. 1 shows a perspective view of an embodiment of a sleeve for holding a plurality of elongate filter units in axial alignment.

FIG. 1 shows a perspective view of one embodiment of a sleeve 1 for holding a plurality of elongate filter units or suchlike which a consumer may carry around with them to conveniently store and protect filter units prior to use. The sleeve 1 comprises a body portion 2 with an elongate, generally cylindrical shape defining a central space 3 extending the length of the body portion 2. The ends 10, 11 of the sleeve 1 are open to enable filter units to be dispensed from either end 10, 11 of the sleeve 1. The sleeve 1 may have a degree of flexibility but is sufficiently rigid to maintain its overall general cylindrical form, unlike wrapping material that has commonly been used in the past to package such filter units and which is deformed or destroyed to enable removal of a filter unit.

The body portion 2 of the sleeve 1 comprises an elongate opening 4 extending between the ends 10,11. The opening 4 is formed by two opposing edges 5, 6 spaced from each other and extending along the length of the body portion 2. Each edge 5, 6 has a wavy, sinusoidal or undulating profile such that the distance between opposing edges 5, 6 of the opening 4 continuously varies along the length of the body portion 2.

The edges are symmetrical with each other about a centreline of the body portion 2. More specifically, as shown in FIG. 1, each edge 5, 6 has a series of undulating peaks 7 and troughs 8 that are aligned with each other so that the peak 7 of edge 5 faces a peak 7 of edge 6. Similarly, a trough 8 of edge 5 faces a trough 8 of edge 6.

The opening 4 provides access to the central space 3 along the length of the body portion 2 that contains filter units inserted into the sleeve 1. The shape of the opening 4 is such that filter units are trapped within the sleeve and cannot escape via the opening 4, but they are still accessible to enable them to be slid along the sleeve 1 towards, and out of, one of the ends 10,11 as explained in more detail below with reference to FIGS. 4, 6 and 7.

The filter units may be inserted into the sleeve 1 via one or both ends 10, 11, or by pulling the opening 4 apart to enlarge the opening 4 and inserting filter units through the enlarged opening 4; the body portion 2 being resilient so that it returns to it's substantially cylindrical shape after being released.

Figure 2:
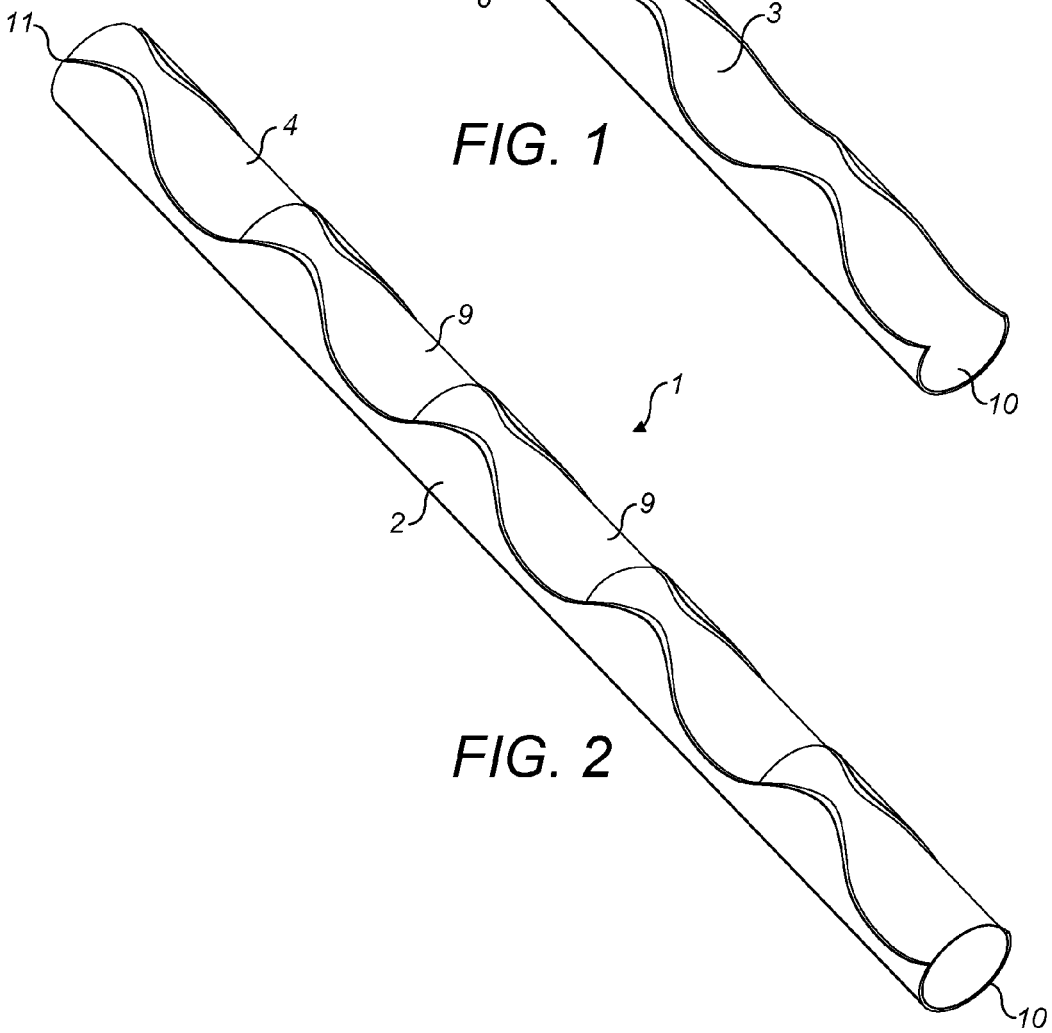
FIG. 2 shows the embodiment of FIG. 1 with five elongate filter units received in the sleeve.

FIG. 2 shows the sleeve 1 of FIG. 1 containing several filter units 9. The filter units 9 are positioned in the central receiving space 3 (see FIG. 1) of the body portion 2 and are insertable and removable through the open ends 10, 11. In this example, the body portion 2 has a length that equates to a whole number of filter units 9, so that filter units 9 are not left protruding from an end 10, 11 of the sleeve 1. The body portion 2 may have a length that equates to any number of axially aligned filter units.

As can be seen in FIG. 2, the opening 4 in the front of the body portion 2 provides access to the central receiving space 3 in which the filter units 9 are received. This allows a user to directly contact and push filter units 9 that are located in the receiving space 3. In this way, a user can easily push filter units 9 towards either end 10, 11 of the body portion 2 to remove the required number of filter units 9 without the need to break, damage or deform the sleeve 1. As filter units can be removed from the sleeve without having to tear or deform the sleeve, a user is able to easily remove filter units from the sleeve without causing damage to the filter units.

Figure 3:
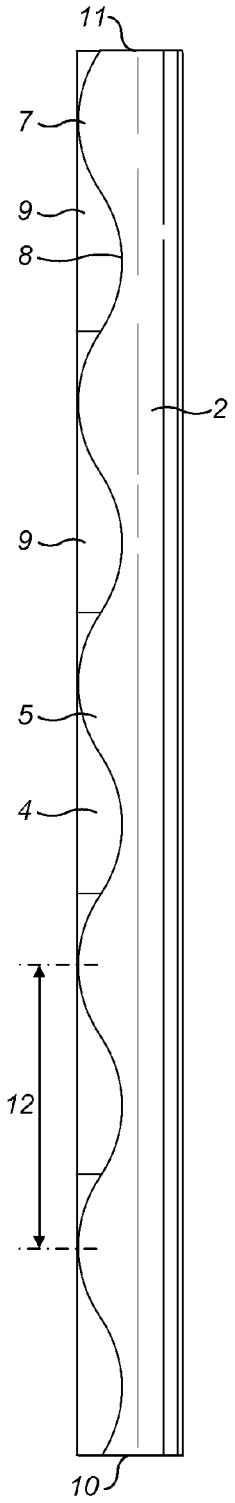
FIG. 3 shows a side view of the embodiment of FIGS. 1 to 2.

FIG. 3 shows a side view of the sleeve with several filter units 9 inserted into the central receiving space (see FIG. 1) of the body portion 2. The peaks 7 and troughs 8 of each undulating edge 5, 6 (see also FIG. 4) of the opening 4 in the body portion 2 are aligned with each other and have a pitch (distance between two peaks), represented by distance 12, that is equal to the length of a filter unit 9. In this way, when a plurality of filter units 9 are received in the central receiving space, as shown, each end of each filter unit 9 is similarly aligned between the peaks 7 and troughs 8 of the undulating edges 5, 6, allowing a user to contact each filter unit 9 via the opening 4 for pushing it out of the sleeve.

In a further example, the undulating edges 5, 6 are arranged such that the ends of the filter units 9 are aligned with the peaks 7 of the undulating edges 5, 6. The example shown in FIGS. 2, 3 and 4 has a non-central alignment between the filter unit 9 and the undulating edges 5, 6 such that a user can contact and push a filter unit 9 along the body portion 2. Alternatively, the peak 7 could be aligned with any point along the length of the filter unit 9.

Alternative examples may have undulating edges with a pitch distance that is not equal to the length of a filter unit, so that the filter units 9 and undulating edges are not consistently aligned along the length of the body portion 2. Alternatively, the undulating edges may have variable pitch distance along the length of the body portion 2 such that some of the filter units are aligned with the peaks and troughs of the edges but others are not.

At the ends 10, 11 of the body portion 2 the undulating edges 5, 6 can be aligned such that the edges 5, 6 are half way between a peak and a trough, as shown in FIG. 3. This allows a user to easily push their finger over the end 10, 11 of the body portion 2 to remove a filter unit 9. Alternatively, at one end 10 the edges 5, 6 may have a trough 8 so that at the other end 11 the edges 5, 6 would have a peak 7. Therefore, a user would be easily able to remove a filter unit 9 from the end 10 which is aligned with the troughs 8.

The opening, however the edges 5, 6 are aligned with the ends of the filter units 9 and the ends 10, 11 of the body portion 2, makes it easy for a user to interact with a filter unit 9 to push that filter unit towards an end 10, 11 of the body portion 2 to remove the filter unit 9 from the sleeve 1.

Figure 4:
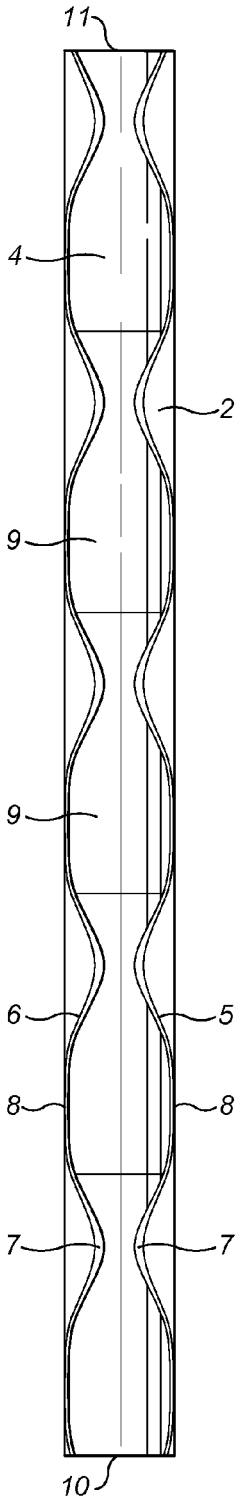
FIG. 4 shows a front view of the embodiment of FIGS. 1 to 3.

FIG. 4 shows a front view of the sleeve 1, clearly showing the form of the opening 4 along the length of the body portion 2. As can be seen, the edges 5, 6 of the opening 4 vary between troughs 8, which are approximately half way around the cylindrical body portion 2, and peaks 7, which approach each other but remain spaced. In this way, the filter units 9 are retained in the body portion 2 except via the end openings 10, 11. The width of the opening 4, the distance between the edges 5, 6, varies along the length of the body portion 2. As previously explained, the distance 12 between each peak 7, the pitch 12 of the undulations, is equal to the length of one filter tip 9 such that the alignment between the edges 5, 6 of the opening 4 and the filter units 9 is consistent along the length of the sleeve 1.

Figure 5:
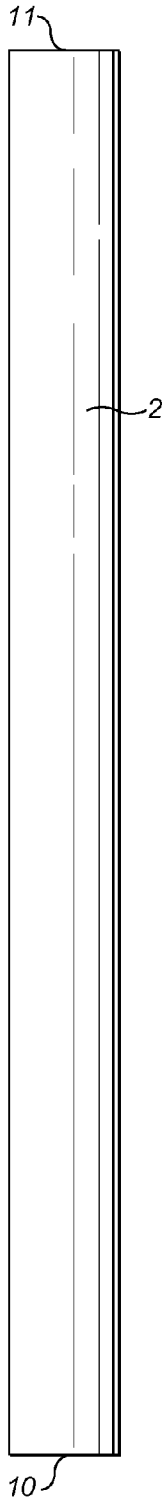
FIG. 5 shows a rear view of the embodiment of FIGS. 1 to 4.

FIG. 5 shows a rear view of the sleeve, with the opening on the opposite side and not visible because the troughs of the opening do not extend beyond half way around the cylindrical body portion 2.

Figure 6:
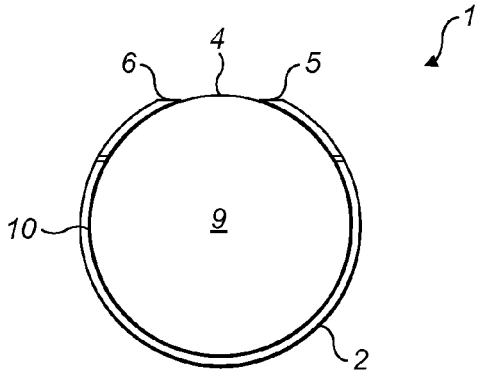
FIG. 6 shows an end view of the embodiment of FIGS. 1 to 5.

FIG. 6 shows an end view of the sleeve 1 with filter units 9 in the central receiving space of the body portion 2. As shown, the edges 5, 6 of the body portion 2 retain the filter units 9 in the sleeve while providing an opening 4 along the body portion 2 that allows a user to contact and push filter units 9 out of the sleeve via the open ends 10, 11 of the body portion 2. The filter units 9 cannot fit through the opening 4 so can only be inserted and removed from the central receiving space of the sleeve via the end openings 10, 11.

Another example of the sleeve has a body portion with only one open end through which the filter units are removable, the other end being closed.

FIG. 6 also shows that the general form of the body portion 2 is cylindrical, to match the cylindrical shape of the filter units 9. The central receiving space 3 (see FIG. 1) is appropriately sized to receive a filter unit 9; the central receiving space 3 may be slightly larger or the same size as the filter unit 9 to allow the filter unit to fit into the central receiving space. Alternatively, the central receiving space 3 may be slightly smaller than the outer diameter of the filter unit 9 so that the body portion 2 would act to clamp and retain the filter units 9 in the sleeve 1. In particular, the diameter of the sleeve may be selected such that filter units are a snug frictional fit within the central space 3 and so that filter units may slide along and within the central space 3 in response to the application of a relatively small amount of pressure applied thereto with a finger but which will not easily fall out as a result of carrying the sleeve in a vertical orientation, i.e. with its longitudinal axis vertical, or even as a result of shaking the sleeve. Although the filter units may simply be held in place due to friction between the internal surface of the body 2 within the space 3 and the outer surface of the filter unit, it will be appreciated that the sleeve 1 may be formed from a resilient material that 'gives' or expands slightly as filter units are inserted into it, so that the filter units are effectively squeezed slightly by the sleeve 1 to hold them in place within the sleeve until force is applied to them by a user to slide them out of the sleeve.

As shown in FIGS. 3 and 6, the opening 4 could be formed by cutting an undulating profile into a side of the elongate body portion 2. The result of this cutting operation is that the edges 5, 6 are flat in the plane of the opening 4, across the body portion 2. The effect is such that when a user places their finger over the opening 4, on the edges 5, 6, to contact the filter units 9 and push a filter unit along the body portion 2, the edges 5, 6 in contact with the finger have a flat profile.

Figure 7:
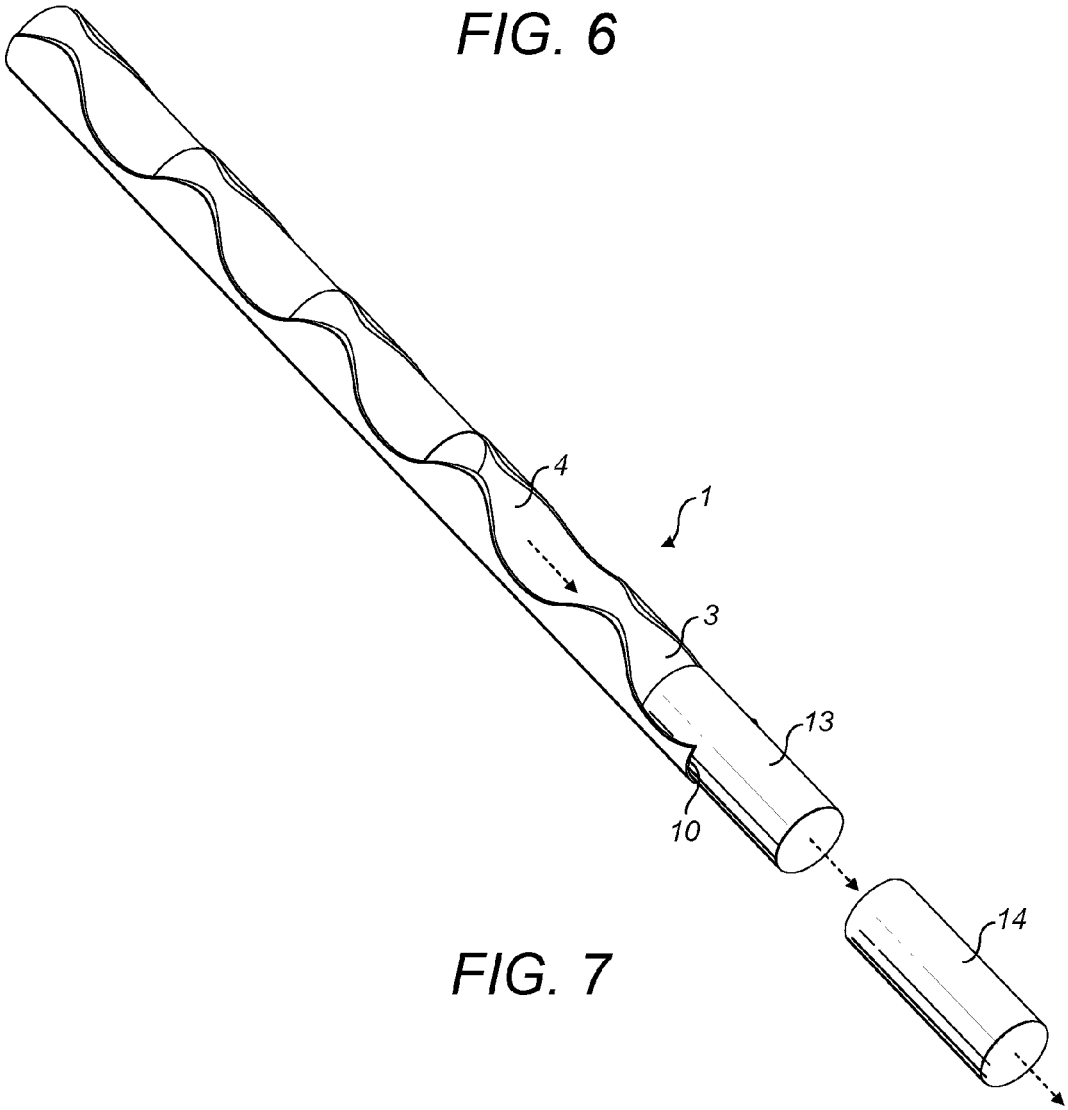
FIG. 7 shows a perspective view of the embodiment of FIGS. 1 to 6 during removal of filter units.

FIG. 7 shows a perspective view of the sleeve 1 for filter units 9 showing a filter unit 13 being removed from the sleeve 1. Filter unit 14 has already been removed from the sleeve 1 and filter unit 13 is in the process of being removed. A user (not shown) is pushing filter unit 13 along the body portion 2, within the central opening 3, by contacting the filter unit 13 via the opening 4. The user may hold the sleeve 1 in one hand and contact the side, end or edge of the filter unit 13 with the thumb of that same hand in order to gain sufficient purchase to move the filter unit 13 along the body portion 2 and out of the end opening 10 of the sleeve 1. Filter units may therefore be removed from the sleeve 1 using only one hand.

In the example shown in FIGS. 1 to 7, the edges 5, 6 of the opening 4 are formed with an undulating profile. However, this is merely an example and other shapes and profiles are envisaged, such as, for example, a saw-tooth profile, a zig-zag profile, a square-wave profile, straight edges, parallel edges or tapered edges or any other profile that allows a user to interact with the filter units in the sleeve to enable them to be slid along the sleeve, but which will also prevent the filter units from escaping from the sleeve via the opening 4.

In another example, the undulating edges do not extend to the ends 10, 11 of the body portion 2. For example, the edges could be tapered close to the ends of the body portion such that the user's finger can easily push a filter unit out of an open end of the body portion.

Figure 8:
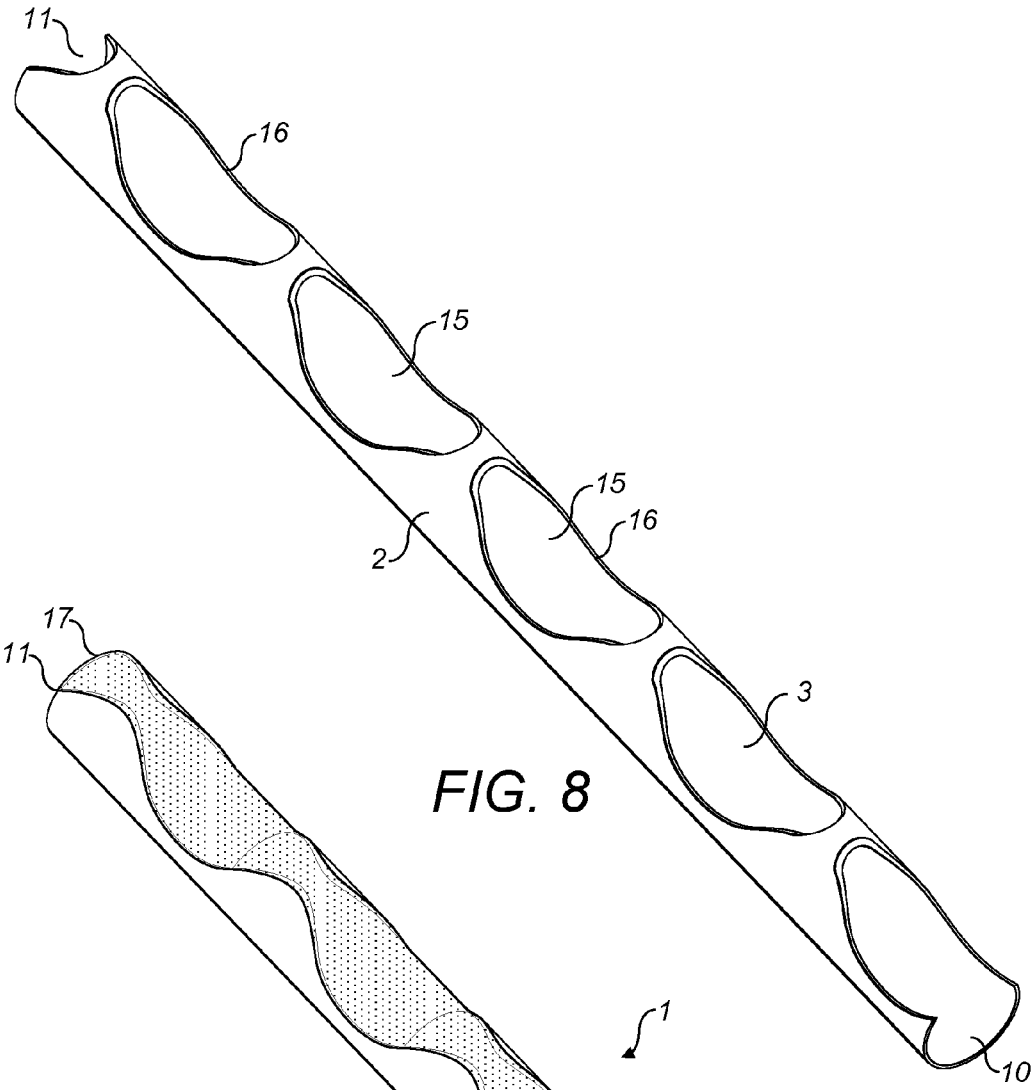
FIG. 8 shows an alternative embodiment of a sleeve for filter units.

Furthermore, the opening may not extend continuously along the length of the body portion 2. In the example shown in FIG. 8, the sleeve comprises a plurality of openings is that allow a user to contact the filter units and move them along the body portion 2 towards the open ends 10, 11. The plurality of openings 15 along the body portion 2 are formed with curved sides 16 such that a user is able to contact the filter units in the sleeve and push filter units towards the open ends 10, 11. Again, the distance between each opening 15 could be equal to the length of a filter to provide consistent alignment between the openings is and the ends of each filter unit.

Figure 9:
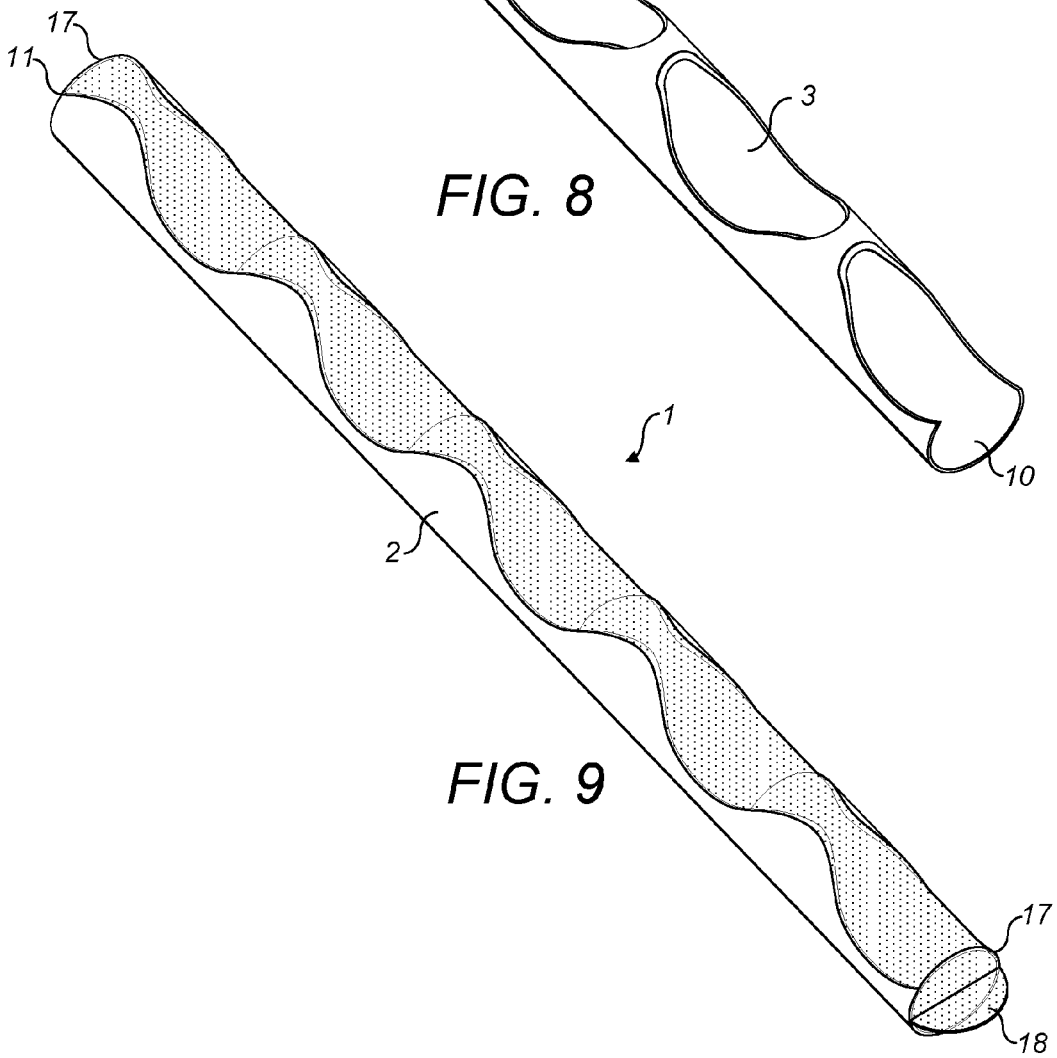
FIG. 9 shows another alternative embodiment of a sleeve for filter units with a removable strip covering the opening.

As shown in FIG. 9, the sleeve may also include a removable tear strip 17 that covers the opening 4 (see FIG. 2) in the main body 2 to complete the cylindrical form of the main body 2. The tear strip 17 is removably attached to the undulating edges 5,6 (see FIG. 2) and has a pull tab 18 that allows a user to remove the tear strip 17 to reveal the opening 4 and remove filter units from the sleeve. Alternatively, the tear strip 17 may be removably attached to only one of the edges 5,6 or only a part of one or both edges, and rigidly attached to the remaining parts of the edges, so that the tear strip 17 can be peeled back to reveal the opening without being completely removed from the sleeve 1.

The removable attachment between the tear strip 17 and the edges 5,6 may include a perforated line or a peelable adhesive joint or any other line of weakness or tear line in the material. FIG. 9 shows a pull tab 18 formed in the tear strip 17 at one end and the tear strip 17 may end over the ends 10, 11 of the sleeve. The pull tab 18 may be formed at one or both ends of the tear strip 17. Alternatively, the tear strip 17 may not extend over the ends of the sleeve 1. The tear strip 17 may be made from a transparent or translucent material, as shown in FIG. 9, so that a user can see the filter units within the sleeve 1. Alternatively, the tear strip 17 may be made from an opaque material. The tear strip 17 may be formed from the same material as the main body 2.

Moreover, the sleeve described in any of FIGS. 1 to 9 may be attached in a back-to-back arrangement to another sleeve, such that more filter units are stored and the product may be easier for a user to hold. The body portions of two sleeves can be adhered to each other such that a user can still access the openings to remove the filter units. The openings of the two sleeves may be opposite each other or in any other positional arrangement that allows a user to access the openings to remove the filter units.

The examples described with reference to FIGS. 1 to 9 refer to a sleeve for filter units for use with smoking articles, such as 'roll your own' cigarettes. However, the invention is not limited to this use and may be used for holding, storing or packaging any other type of elongate element for sequentially dispensing those elements.

It is envisaged that the sleeve could be used for holding and inserting rod shaped flavour elements into a recess in a filter element in a smoking article. Such a smoking article with a recess for receiving rod shaped flavour elements is disclosed in the applicant's GB patent application number 1110863.6, which is hereby fully incorporated by reference.

The sleeve containing the rod shaped elements can be held adjacent to, partially or fully inserted into the recess and a user can push a flavour element out of the sleeve, directly into the recess in the filter end of the smoking article for receiving the flavour element. In this way, the user need not directly contact and manipulate the flavour element, which may cause flavour or other residues to transfer from the flavour element to the user's hands. Also, the flavour elements are small and easily dropped or lost and the sleeve reduces the likeliness of mishandling the flavour elements. The sleeve allows the user to push flavour elements directly from the sleeve into the receiving space. If the sleeve is used to dispense filter elements, they may also be dispensed from an end of the sleeve directly into a smoking article.

A sleeve containing flavour elements for this purpose can be designed such that it fits within a packet of smoking articles that have recesses to receive such flavour elements. In this case, the sleeve can be of equal length to the smoking articles in the packet.

In a further example, the sleeve can be used to load rod shaped elements into a filter dispensing or insertion device, such as that disclosed in the applicant's GB patent application number 1116800.2, which is hereby fully incorporated by reference. The dispensing device receives rod shaped elements in an inner cavity and a user actuated mechanism causes the rod shaped elements to be dispensed from an end of the device. The sleeve containing the rods can be held adjacent to the device and a user can push the rod elements out of the sleeve directly into the device. Alternatively, the device can be designed to receive the sleeve with the rod elements within the device and the mechanism can be configured to push the rod elements out of the sleeve and out of the dispensing device.

The sleeve described with reference to FIGS. 1 to 9 can be made from a polymer material such that the sleeve has sufficient rigidity to prevent the filter units falling out of the sleeve via the opening but resilient enough to allow the filter units to be slid along the sleeve in response to the application of pressure thereto with a finger or thumb. The sleeve may be made from a transparent or translucent material such that a user can see the quantity, colour and position of the filter units within the sleeve.

In order to address various issues and advance the art, the entirety of this disclosure shows by way of illustration various embodiments in which the claimed invention(s) may be practiced and provide for a superior sleeve for an elongate element. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A sleeve for holding and dispensing a plurality of elongate filter units, the sleeve holding a plurality of elongate filter units for a smoking article, the filter units being positioned in end-to-end relationship, the sleeve comprising a substantially cylindrical elongate body portion having opposing ends, at least one of which is open to enable the filter units to be dispensed therefrom and defining a space therebetween in which the filter units are held, the diameter of the sleeve being such that the filter units are a snug frictional fit within the space whilst also being able to slide longitudinally within the space in response to application of pressure to the filter units by a user; the elongate body portion defining an opening between the opposing ends that is configured such that a user can contact the filter units held in said sleeve through said opening and apply the pressure to push them longitudinally along, and out of one end of, said sleeve.

2. The sleeve according to claim 1, wherein the opening extends in a longitudinal direction between said ends.

3. The sleeve according to claim 1, wherein the opening is defined between two opposing edges of the body portion, said edges being spaced from each other by a constant distance for a length of the opening.

4. The sleeve according to claim 1, wherein the opening is defined between two opposing edges of the body portion, said edges being spaced from each other by a distance that varies along a length of the opening.

5. The sleeve according to claim 4, wherein the distance varies between a maximum and a minimum distance along a length of the opening.

6. The sleeve according to claim 3, wherein each edge has a waveform shape.

7. The sleeve according to claim 6, wherein the waveform shape has peaks and troughs, the peaks and troughs of each edge being in alignment with each other along the length of the opening.

8. The sleeve according to claim 6, wherein the waveform shape of each edge is continuously curved.

9. The sleeve according to claim 4, wherein a spacing distance between the opposing edges at a widest point is equal to up to half a total circumference of the sleeve.

10. The sleeve according to claim 1, wherein the opening is continuous along a length of the body portion.

11. The sleeve according to claim 10, wherein the opening extends for an entire length of the body portion.

12. The sleeve according to claim 1, comprising a series of discrete openings spaced from each other along a length of the body portion.

13. The sleeve according to claim 3, wherein the opposing edges are flattened or angled so that when a user makes contact with an elongate element through the opening, contact will also be made with said flattened or angled edges.

14. The sleeve, according to claim 6, further comprising a pitch of the waveform shape being substantially the same as a length of an elongate element received therein.

15. The sleeve, according to claim 1, further comprising a strip that covers the opening, said strip comprising a pull tab such that a user can at least partially remove the strip from the sleeve by pulling on the pull tab.

16. A method of dispensing an elongate filter unit of said plurality of elongate filter units for a smoking article from said sleeve according to claim 1, the method comprising contacting, through the opening, said filter unit to be dispensed and applying a pressure to said filter unit to slide it longitudinally along and out of one end of said sleeve.

* * * * *